US006010435A

United States Patent [19]

Tanabe

[11] Patent Number: 6,010,435

[45] Date of Patent: Jan. 4, 2000

[54] SOFT SWORD AND SOFT ROD

[76] Inventor: Tetsundo Tanabe, 2-16-17 Kaminagaya, Konan-ku, Yokohama-shi, Kanagawa 233, Japan

[21] Appl. No.: 08/549,732

[22] PCT Filed: Mar. 15, 1995

[86] PCT No.: PCT/JP95/00439

§ 371 Date: Jan. 5, 1996

§ 102(e) Date: Jan. 5, 1996

[87] PCT Pub. No.: WO95/24951

PCT Pub. Date: Sep. 21, 1995

[30] Foreign Application Priority Data

| | | | |
|---|---|---|---|
| Mar. 15, 1994 | [JP] | Japan | 6-043926 |
| Sep. 9, 1994 | [JP] | Japan | 6-215916 |
| Nov. 22, 1994 | [JP] | Japan | 6-287956 |

[51] Int. Cl.[7] ..... A63H 33/00; A63B 69/02

[52] U.S. Cl. ..... 482/83; 482/109; 473/564; 473/168; 446/473

[58] Field of Search ..... 482/83, 109; 463/47.1, 463/47.2, 47.7; 473/569, 168; 446/473

[56] References Cited

U.S. PATENT DOCUMENTS

| | | | |
|---|---|---|---|
| 2,669,062 | 2/1954 | Baggott | 463/47.1 |
| 4,080,751 | 3/1978 | Copstead | 446/220 |
| 4,328,966 | 5/1982 | Miyamoto . | |
| 4,892,303 | 1/1990 | Lohrg | 482/83 |
| 5,127,871 | 7/1992 | Miller | 446/473 |
| 5,219,163 | 6/1993 | Watson | 463/47.2 |
| 5,295,926 | 3/1994 | Tanabe . | |
| 5,330,403 | 7/1994 | Kuo . | |
| 5,389,033 | 2/1995 | Rauch | 446/473 |
| 5,598,596 | 2/1997 | Song et al. | 463/47.2 |

FOREIGN PATENT DOCUMENTS

| | | |
|---|---|---|
| 495071 U | 8/1992 | Japan . |
| 3001004 | 8/1994 | Japan . |

OTHER PUBLICATIONS

"Sports Chanbara" by Tetsundo Tanabe, President of International Sports Chanbara Assoc. (1994).

*Primary Examiner*—Jerome Donnelly
*Attorney, Agent, or Firm*—Bachman & LaPointe, P.C.

[57] ABSTRACT

A bag-shaped sword blade section having a throttled opening formed of a sealing and elastic material such as rubber is fitted onto and closely attached to a tip end of a cylindrical-shaped grip formed of a hard material such as wood, a hard rubber, plastics and metals. A gas such as air is filled in the sword blade section to define a cavity. Accordingly, a soft sword is made uniform in quality, and undergoes less degradation in quality even after an extended use.

21 Claims, 24 Drawing Sheets

SOFT SWORD AND SOFT ROD

TECHNICAL FIELD

The present invention relates to a soft sword, a soft spear, and a soft rod, which are used for sport chanbara (a registered trademark), namely a kind of the art of self-defense.

BACKGROUND OF THE PRESENT INVENTION

A soft sword (a), a soft spear (b), and a soft rod (c), as shown in FIG. 23, have been used for sport chanbara, which is rapidly spreading as the art of self-defense (fencing) in recent years, in order not to require a protector.

In the prior arts, for example, a soft sword consists of a stem 91, urethane 92 rolled round the stem 91, a bag 93, which is made of cloth or leather, and covers the urethane 92 as shown in FIG. 24.

Thanks to the elasticity of the urethane 92, this soft sword is free from hurting the opponent, therefore, it is very favorable.

However, this soft sword has the following problems:

(1) The irregularity of the quality of the urethane and others makes the performance of the soft swords irregular, so it may cause much unfairness in a match.

(2) The urethane must be exchanged for new one once in six months or so, because it becomes stiff while used. However, in case the user does not exchange the urethane for new one and uses the soft sword long, an accident may happen.

SUMMARY OF THE INVENTION

An object of the present invention is to provide a soft sword and a soft rod, which are uniform in quality and undergo less degradation, by using gas as a elastic material instead of urethane.

In order to achieve the object, a soft sword of the present invention is formed as follows:

(1) A soft sword comprising:

a grip, which is made of a hard material; and a bag-shaped sword blade section, which is made of a sealing and elastic material and the opening of which is fitted onto and closely attached to a tip end of said grip; wherein said sword blade section is filled with gas to define a cavity.

Furthermore, in order that said sword blade section is to be more stable, a soft sword is formed as follows:

(2) A soft sword comprising:

a grip, which is made of a hard material; a bag-shaped sword blade section, which is made of a sealing and elastic material and the opening of which is fitted onto and closely attached to a tip end of said grip; and an inner stem, which continues to said grip and protrudes inside said sword blade section; wherein said sword blade seciton is filled with gas to define a cavity.

In this soft sword, it does not matter which is the thicker, said inner stem or said grip. The length of said inner stem is changeable as far as it goes in said sword blade section.

It is possible either that said inner stem and said grip is made of the same material or that said inner stem is made of a softer material than said grip and adheres to said grip.

(3) A soft sword comprising:

a grip, which is made of hard material; a bag-shaped inner bag, which is made of a sealing and elastic material and the opening of which is fitted onto and closely attached to a tip end of said grip; and a bag-shaped sword blade section, which is made of a sealing and elastic material and covers said inner bag and the opening of which is fitted onto and closely attached to said grip; wherein said inner bag and said sword blade section are filled with gas to define cavities.

In this soft sword, it is favorable that pressure inside said inner bag is higher than that between said sword blade section and said inner bag, because the stability of said sword blade section increases.

Furthermore, in order that said sword blade section is to be still more stable, a soft sword is formed as follows:

(4) A soft sword comprising;

a grip, which is made of a hard material; a bag-shaped sword blade section, which is made of a sealing and elastic material and the opening of which is fitted onto and closely attached to a tip end of said grip; an inner stem, which continues to said grip and protrudes inside said sword blade section; and an outer stem, which exsists inside said sword blade section and rolls round said inner stem; wherein said sword blade section is filled with gas to define a cavity.

In order to be lighter, a soft sword is formed as follows:

(5) A soft sword comprising:

a sword blade section, which is made of a sealing and elastic material; and a grip section, which is made of the same material as said sword blade section and formed in one body with said sword blade section; wherein said sword blade section and said grip is formed bag-shaped and filled with gas and sealed.

Additionaly, in order that said sword blade section is to be more stable, a soft sword is formed as follows:

(6) A soft sword comprising:

a bag-shaped inner bag, which is made of a sealing and elastic material; a sword blade seciton, which is made of a sealing and elastic material; and a grip section, which is made of the same material as said sword blade section and formed in one body with said sword blade section; wherein said sword blade section and said grip section is formed bag-shaped and covers said inner bag, and said inner bag, said sword blade section and said grip section are filled with gas and sealed.

In this soft sword, it is favorable that pressure inside said inner bag is higher than that inside said sword blade section and said grip section and outside inner bag, because the stability of said sword blade section increases.

In order to be made more easily, a soft sword is formed as follows:

(7) A soft sword comprising:

a grip, which is made of a elastic material; a trunk section, which is forme in one body with said grip and thicker than said grip; and a bag-shaped sword blade section, which is made of a sealing and elastic material and the opening of which is fitted onto and closely attached to said trunk section; wherein said sword blade section is filled with gas to define a cavity.

In this soft sword, it is favorable that said trunk section is bored in the shape of a corn, because the soft sword is more usable.

Furthermore, in order that the hardness of the soft sword above keeps best, a soft sword is formed as follows: A soft sword according to (1), (2), (4) or (7) mentioned above, further comprising:

a vent, which leads from an end of said grip to said sword blade section, and through which gas is supplied into inside said sword blade section; and a valve, which is provided at an end of said vent and prevents gas inside said sword blade section from leaking, and through which gas can be supplied into inside said sword blade section.

A soft sword according to (3) mentioned above, further comprising:

a first vent, which leads from an end of said grip to said sword blade section, and through which gas is supplied into inside said sword blade section;

a first valve, which is provided at an end of said first vent and prevents gas inside said sword blade section from leaking, and through which gas can be supplied into inside said sword blade section; a second vent, which leads to from an end of said grip to said inner bag, and through which gas is supplied into inside said inner bag; and a second valve, which is provided at an end of said second vent and prevents gas inside said inner bag from leaking, and through which gas can be supplied into inside said inner bag.

A soft sword according to (5) or (6) mentioned above, further comprising:

a valve, which is provided at the end of said grip section and prevents gas inside said sword blade section and said grip section from leaking, and through which gas can be supplied into inside said sword blade seciton and said grip section.

Furthermore, in order to use not only as a soft sword but also as a soft spear or a soft rod, a soft sord is formed as follows:

A soft sword according to (1)–(4) or (7) mentioned above, further comprising a screw at a tip end of said grip.

A soft sword mentioned above is more favorable when their sword blade section are covered with a bag, which is made of a non-elastic material, to fix the shape of their sword blade section.

In order to achieve the object as mentioned above, a soft rod of the present invention is formed as follows:

A soft rod comprising:

a bag-shaped sword blade section, which is made of a sealing and elastic material and has no opening; a valve, which is provided at the center of said sword blade section and prevents gas inside said sword blade section from leaking, and through which gas can be supplied into inside said sword blade section; and a hollow cylindrical-shaped grip, which has a hole at the center; wherein said sword blade section is inserted to the hollow part of said grip, said valve is put into the hole of said grip, and said sword blade section is filled with gas to define a cavity.

Each of a soft sword or a soft rod of the present invention does not make the opponent feel so much pain when its sword blade section hits the opponent, because gas inside its sword blade section as mentioned above works as a cushion. It does not cause irregularity in quality becuase of the construction that the sword blade seciton is filled with gas.

Furthermore, as it does not become stiff while it is used, it is safer.

DETAILED DESCRIPTION OF PREFERRED EMBODIMENTS

Soft swords of the present invention will be explained below referring views wherein the examples are shown.

(EXAMPLE 1)

Figure 1:
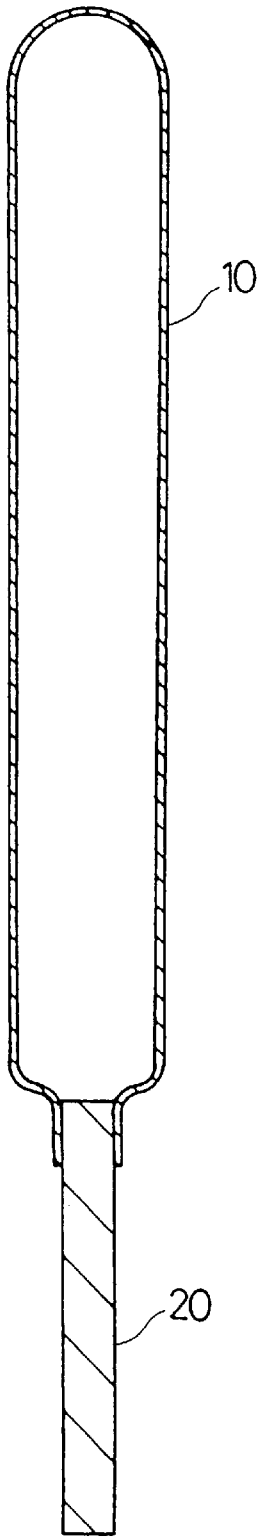
FIG. 1 is a sectional view of a soft sword of Example 1.
Figure 2A:
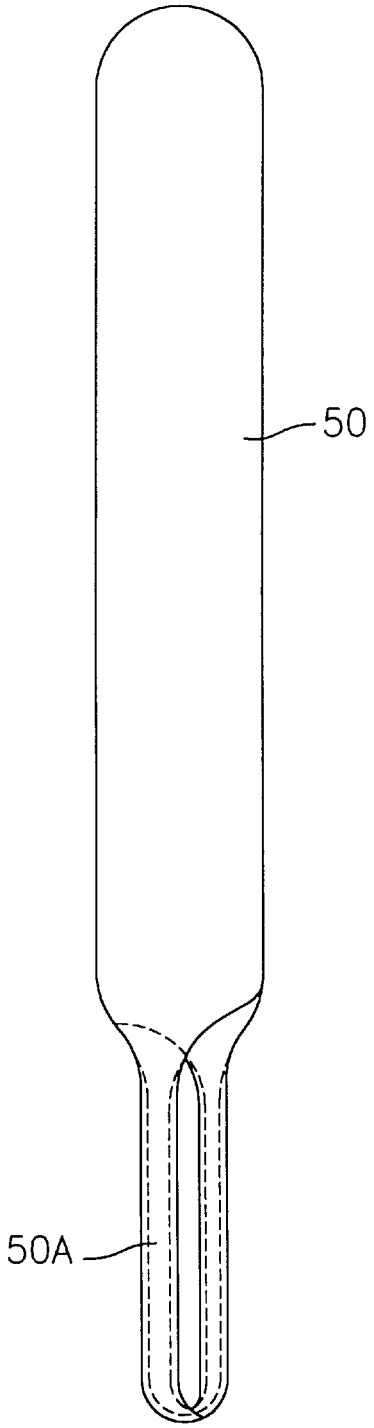
FIG. 2 is a view illustrating parts for a soft sword of Example 1.
Figure 2B:
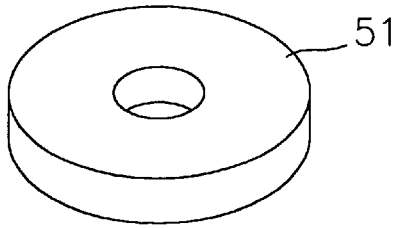
Figure 2C:
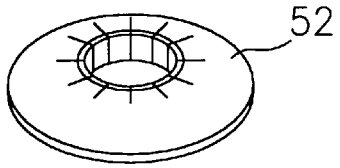
Figure 2D:
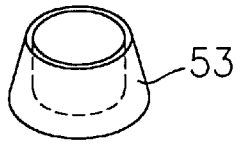
Figure 2E:
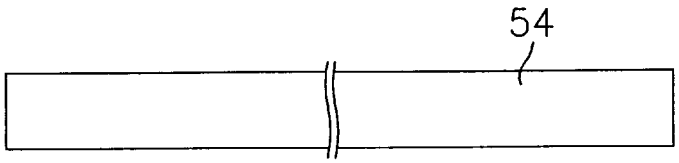

FIG. 1 shows a sectional view of a soft sword of Example 1. The soft sword in this figure is semi-finished and will be completed by fitting a bag made of cloth, a sword guard, and others onto it, as described later.

In this figure, 20 is a cylindrical-shaped grip, which is made of wood. 10 is a bag-shaped sword blade section having a throttled opening, which is made of rubber. The sword blade section 10 is filled with air to define a cavity and its opening fits onto and closely attaches to a tip end of the grip 20. Though the elasticity of rubber fixes the sword blade section 10 to the grip 20 in this Example, the soft sword will be solider if they are glued together.

Accordingly, when the soft sword is formed as mentioned above, the soft sword is free from hurting the opponent while used for practice of the art of self-defense, because the air inside the sword blade section works as a cushion. Furthermore, it makes easy to make a soft sword, which is made uniform in quality and undergoes less degradation in quality.

The method to complete the soft sword will be explained below.

FIG. 2 is a view illustrating parts necessary for completing a semi-finished soft sword. In this figure, 50 is a cloth bag having a drawstring 50A, which covers the sword blade section 10 (A). 51 is a sword guard, which divides the sword blade section from the grip (B). 52 is a sword guard stop, which prevents the sword guard from dropping. 53 is a stopcock, which prevents the soft sword from slipping through a user's hand when a user swings the soft sword. 54 is a griptape, which gives moderate friction to the grip and prevents the soft sword from slipping.

Figure 3:
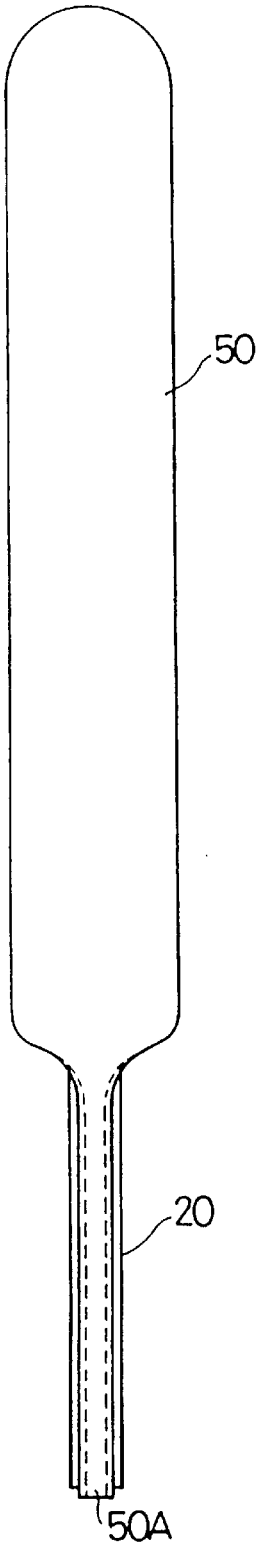
FIG. 3 is an explanatory drawing illustrating how to assemble a soft sword of Example 1.

First, as shown in FIG. 3, the cloth bag 50 is put to cover the sword blade section 10 of the soft sword and the shape of the sword blade section is arranged. Then, the griptape 54 is put to wind the grip 20 and the drawstring 50A. Then, the sword guard 51 is inserted into between the grip 20 and the sword blade section 10, and the sword guard stop 52 is fixed in order not to drop the sword guard 51. Then, the stopcock 53 is fixed at an end of the grip 20, and a part of the drawstring 50A, which is not winded with the griptape is pulled to set on the stopcock 53.

Figure 4:
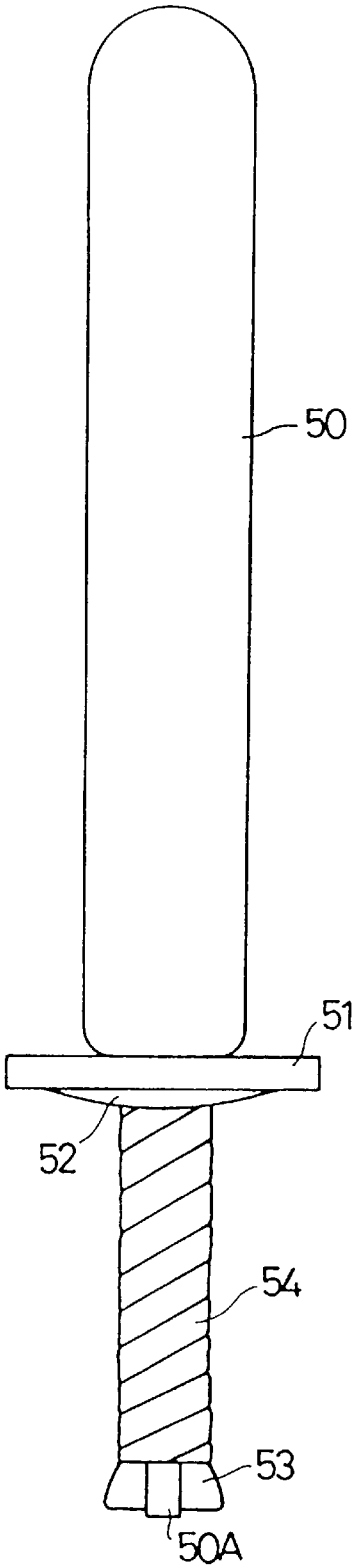
FIG. 4 is a view of a completed soft sword of Example 1.

In this way, the soft sword, as shown in FIG. 4, is completed.

Furthermore, the grip 20 may be made of another hard material such as hard rubber, plastics, and metals. The sword blade section 10 may be made of another sealing and elastic material other than rubber. The cloth bag 50 may be made of another non-elastic material such as leather and polyvinyl.

(EXAMPLE 2)

Figure 5:
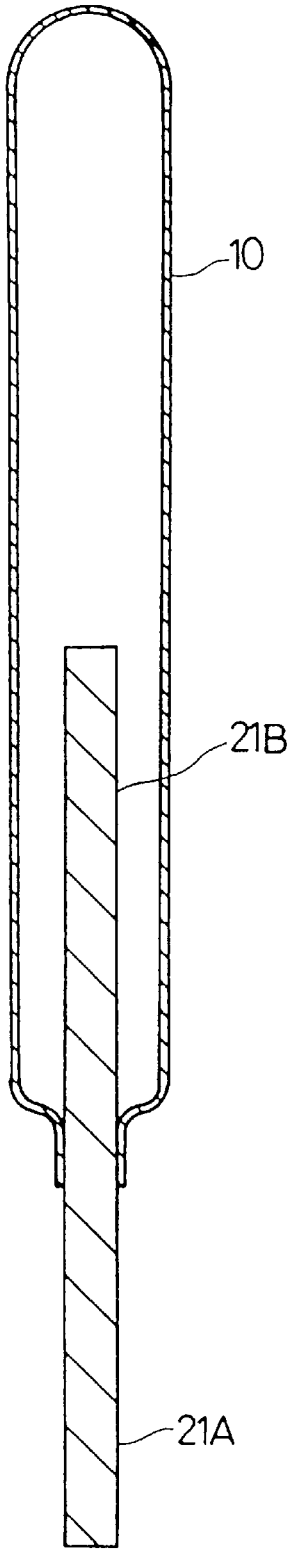
FIG. 5 is a sectional view of a soft sword of Example 2.

FIG. 5 shows a sectional view of a soft sword of Example 2. The soft sword in this figure is semi-finished as that of Example 1.

In this figure, 21A is a grip, and 21B is an inner stem. They are made of wood and formed in one body. The sword blade section 10 is formed as same as that of Example 1. Its opening fits onto and closely attaches to a tip end of the grip 21A. The inner stem 21B protrudes into the cavity inside the sword blade section 10, though it does not reach the end of the sword blade section 10. The grip 21A is made as thick as the inner stem 21B.

Accordingly, when the soft sword is formed as mentioned above, the sword blade section 10 moves less and is more stable than that of Example 1, and the soft sword does not have any problems in view of the safety because it has some room for the inner stem 21B in case of spearing the opponent with it.

The method to complete the semi-finished soft sword of this Example is as same as that of Example 1, and the explanation will be omitted.

(EXAMPLE 3)

Figure 6:
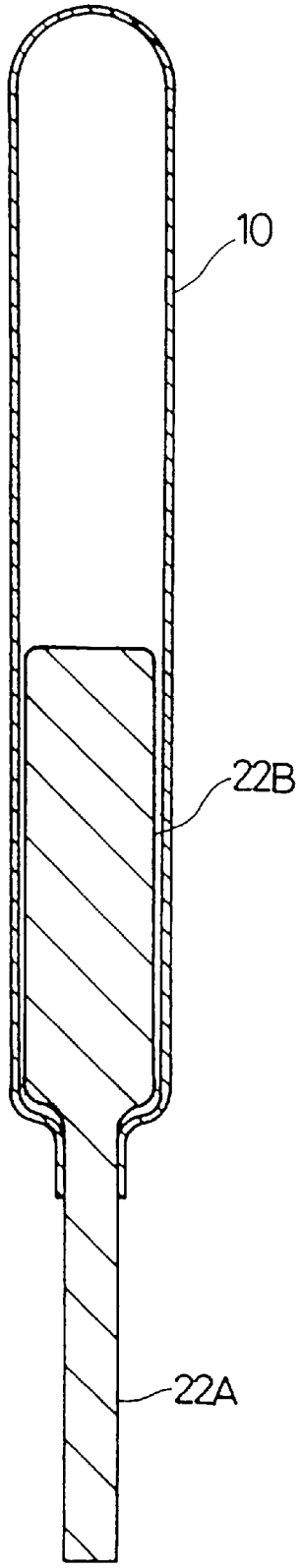
FIG. 6 is a sectional view of a soft sword of Example 3.

FIG. 6 shows a sectional view of a soft sword of Example 3. The soft sword in this figure is semi-finished as those of Examples 1 and 2.

The soft sword of this example is formed almost as same as that of Example 2, but it is different from that of Example 2 in the point that the inner stem 22B is thicker than the grip 22A.

Accordingly, when the soft sword is formed as mentioned above, though it is heavier and less usable than that of Example 2, the sword blade section 10 is still more stable than that of Example 2.

The method to complete the semi-finished soft sword of this example is as same as that of example 1, and the explanation will be omitted.

(EXAMPLE 4)

Figure 7:
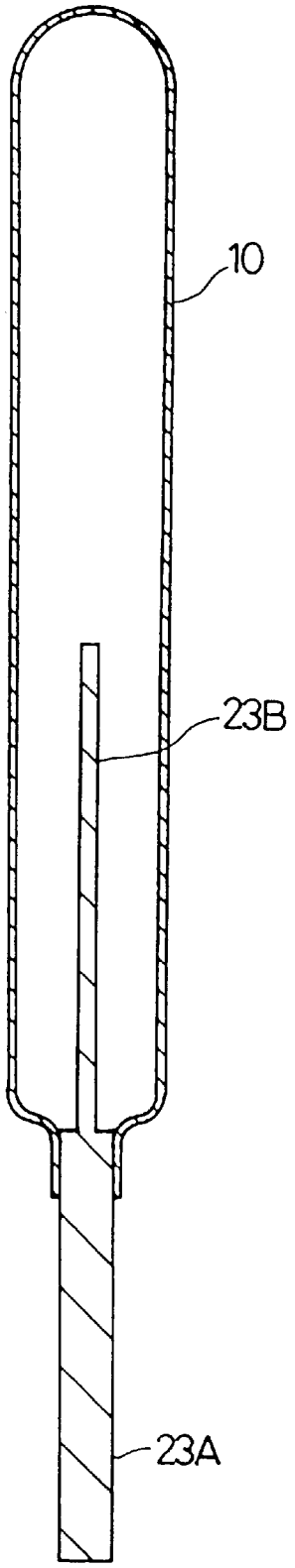
FIG. 7 is a sectional view of a soft sword of Example 4.

FIG. 7 shows a sectional view of a soft sword of Example 4. The soft sword in this figure is semi-finished as those of Examples 1 to 3.

The soft sword of this example is formed almost as same as that of example 2, but it is different from that of Example 2 in the point that the inner stem 23B is thinner than the grip 23A.

Accordingly, when the soft sword is formed as mentioned above, it is lighter and more usable than that of Example 2, though the sword blade section is less stable than that of Example 2.

The method to complete the semi-finished soft sword of this example is as same as that of Example 1, and the explanation will be omitted.

(EXAMPLE 5)

Figure 8:
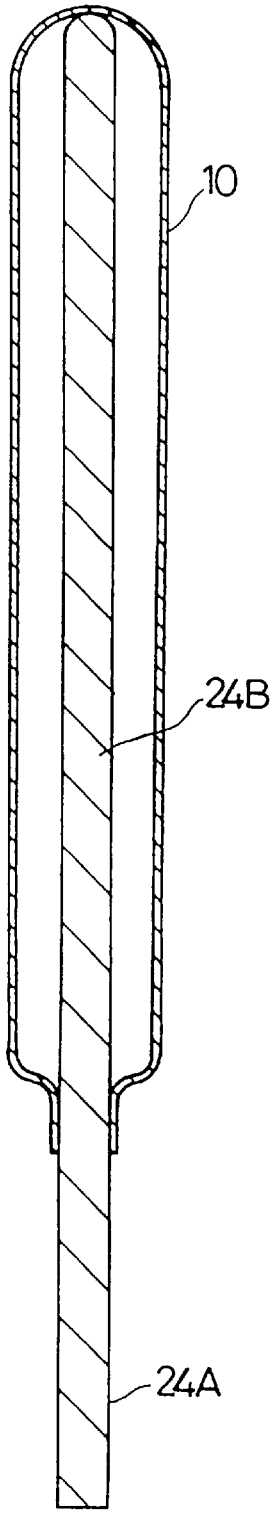
FIG. 8 is a sectional view of a soft sword of Example 5.

FIG. 8 shows a sectional view of a soft sword of Example 5. The soft sword in this figure is semi-finished as those of Examples 1 to 4.

The soft sword of this example is formed almost as same as that of Example 2, but it is different from that of Example 2 in the point that the inner stem 24B reaches the end of the sword blade section 10.

Accordingly, when the soft sword is formed as mentioned above, though it is less safe than that of Example 2 when spearing with it, the sword blade section is very stable to its tip end.

Though the grip 24A is as thick as the inner stem 24B in this example, their thickness may be altered as that of Example 3 or 4.

The method to complete the semi-finished soft sword of this example is as same as that of example 1, and the explanation will be omitted.

(EXAMPLE 6)

Figure 9:
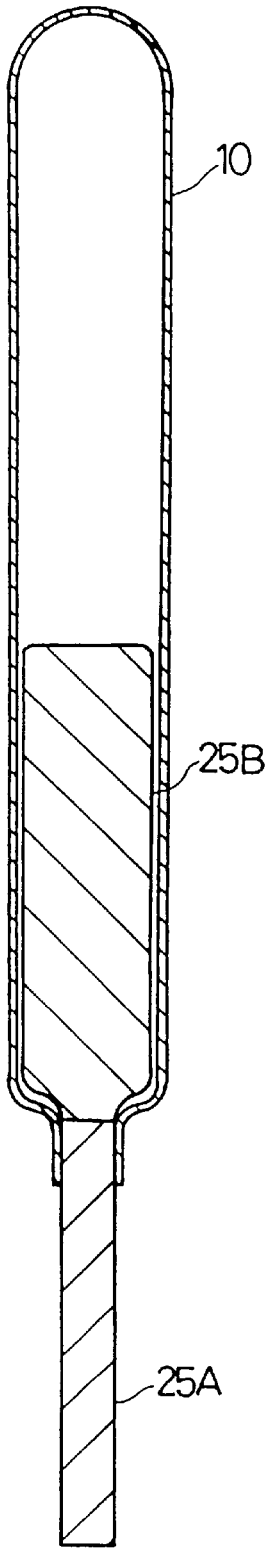
FIG. 9 is a sectional view of a soft sword of Example 6.

FIG. 9 shows a sectional view of a soft sword of example 6. The soft sword in this figure is semi-finished as those of Examples 1 to 5.

The soft sword of this example is formed almost as same as that of Example 3, but it is different from that of Example 3 in the point that the grip 25A and the inner stem 25B are not made of same material and formed in one body, but formed separately and put together. The inner stem 25B is made of softer material, such as sponge, rubber or urethane, than the grip 25A, and it is glued to the grip 25A.

Accordingly, when the soft sword is formed as mentioned above, the soft sword gives less shock and is still safer than that of Example 3 in case the part of the sword blade section 10 near the grip hits the body.

Though the inner stem 25B is thicker than the grip 25A in this example, their thickness may be altered as that of Example 2, 4 or 5.

The method to complete the se mi-finished soft sword of this example is as same as that of Example 1, and the exaplanation will be omitted.

(EXAMPLE 7)

Figure 10:
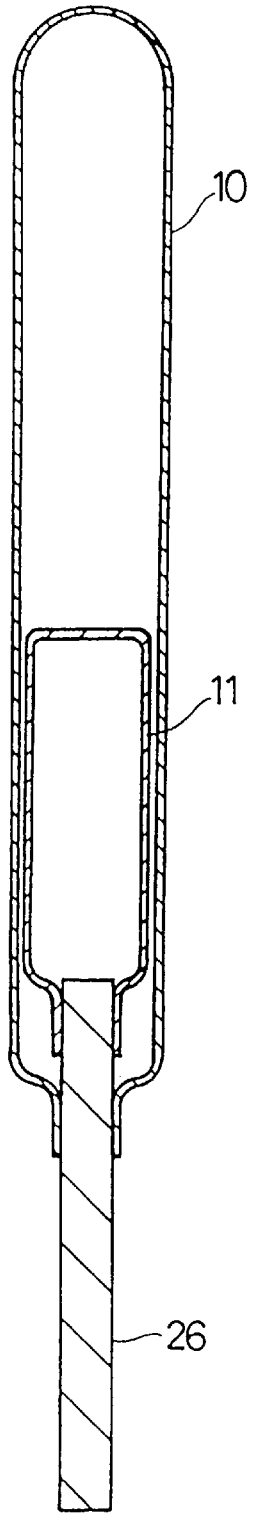
FIG. 10 is a sectional view of a soft sword of Example 7.

FIG. 10 shows a sectional view of a soft sword of Example 7. The soft sword in this figure is semi-finished as those of Examples 1 to 6.

In this figure, 26 is a cylindrical-shaped grip, which is made of wood. 10 is a bag-shaped sword blade section having a throttled opening, which is made of rubber. 11 is a bag-shaped inner bag having a throttled opening, which is made of rubber. The inner bag 11 is filled with air to define a cavity and its opening fits onto and closely attaches to a tip end of the grip 26. The sword blade section 10 is filled with air to define a cavity and its opening fits onto and closely attaches to the grip 26 as it covers the inner bag 11 but does not overlap the inner bag 11. In this soft sword, it is preferable that the air pressure inside the inner bag 11 is higher than that between the sword blade section 10 and the inner bag 11.

Accordingly, when as the soft sword is formed as mentioned above, it makes possible to make a soft sword safer in case the sword blade section hits a body and more durable than those of Examples 2 to 6. Furthermore, the sword blade seciton 10 is more stable if the air pressure inside the inner bag 11 is higher than that between the sword blade section 10 and the inner bag 11.

The method to complete the semi-finished soft sword of this example is as same as that of Example 1, and the explanation will be omitted.

(EXAMPLE 8)

Figure 11:
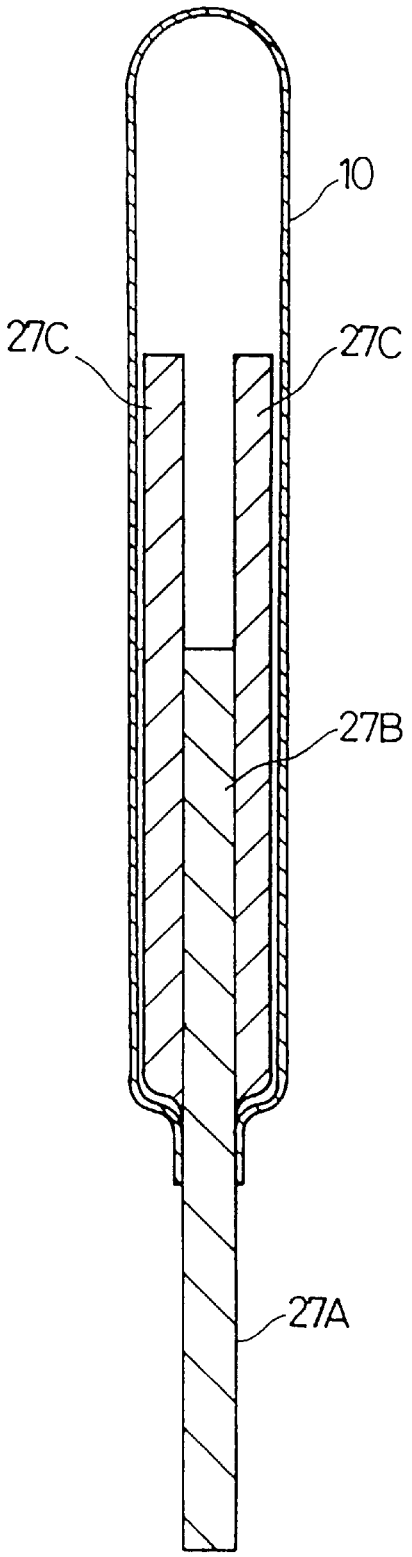
FIG. 11 is a sectional view of a soft sword of Example 8.

FIG. 11 shows a sectional view of a soft sword of Example 8. The soft sword in this figure is semi-finished as those of Examples 1 to 7.

The soft sword of this example is formed almost as same as that of Example 2, but it is different from that of Example 2 in the point that there is an outer stem 27C, which is made of a soft material such as sponge and urethane, around the inner stem 27B. It does not matter whether or not the outer stem 27C touches the sword blade section 10.

Accordingly, when the soft sword is formed as mentioned above, the sword blade section 10 is still more stable than that of Example 2, though the soft sword is less durable than that of Example 2. Furthermore, it is more usable if the outer stem 27C is longer than the inner stem 27B, because the stability increases gradually from a tip end of the sword blade section 10 to the grip 27A, and the sword blade section 10 bends flexibly when the soft sword is swung.

The method to complete the semi-finished soft sword in this example is as same as that of Example 1, and the explanation will be omitted.

(EXAMPLE 9)

Figure 12:
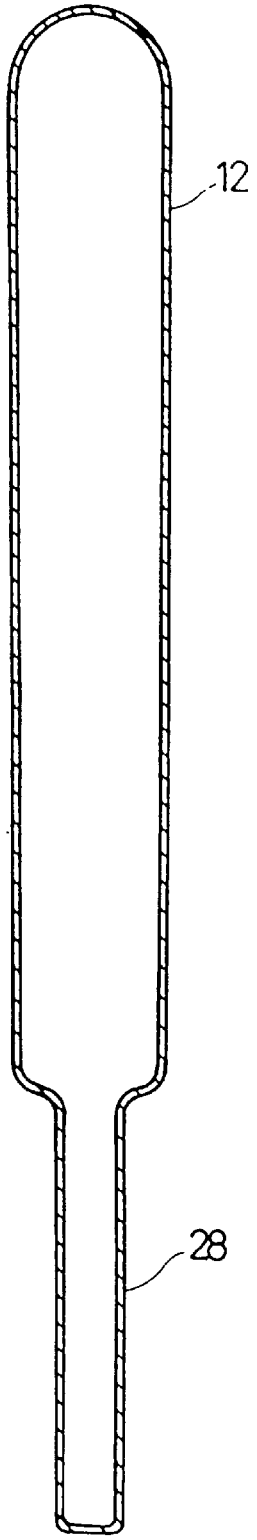
FIG. 12 is a sectional view of a soft sword of Example 9.

FIG. 12 shows a sectional view of a soft sword of Example 9. The soft sword in this figure is semi-finished as those of Examples 1 to 8.

In this figure, 12 is a sword blade section, which is made of rubber. 28 is a grip section, which is thinner than the sword blade section 12, made of the same material as the sword blade section 12, and formed in one body with the sword blade section 12. The sword blade section 12 and the grip section 28 is filled with air and made airtight by shutting its opening.

Accordingly, when the soft sword is formed as mentioned above, the soft sword, which does not undergo degradation in quality, is usable for children who do not have enough power, because it is lighter than those of Examples 1 to 8. Furthermore, it can be made easily.

The method to complete the semi-finished soft sword in this example is as same as that of Example 1, and the explanation will be omitted.

(EXAMPLE 10)

Figure 13:
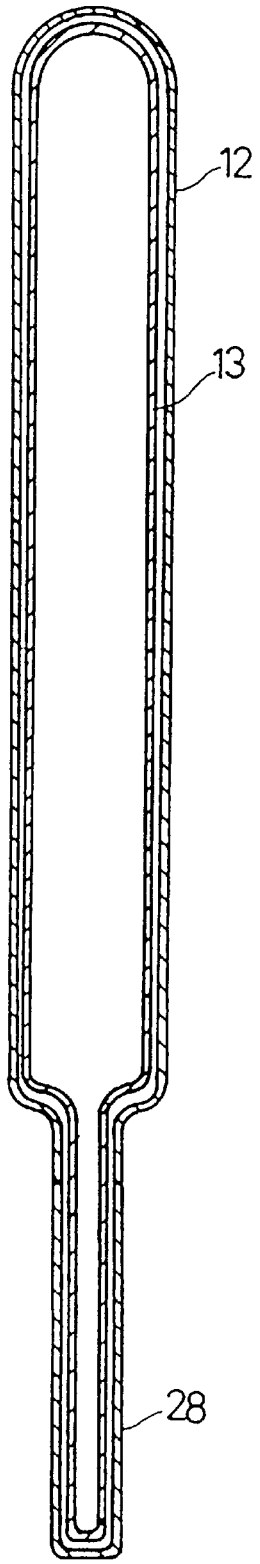
FIG. 13 is a sectional view of a soft sword of Example 10.

FIG. 13 shows a sectional view of a soft sword of Example 10. The soft sword in this figure is semi-finished as those of Examples 1 to 9.

In this figure, 13 is an inner bag, which is made of rubber. The sword blade section 12 and the grip seciton 28 as same as that of Example 9 covers over the inner bag 13. The inner bag 13 is filled with air and made airtight by shutting its opening. Also the sword blade secition 12 and the grip section 28 is filled with air and made airtight by shutting its opening. In this soft sword, it is preferable that the air pressure inside the inner bag 13 is higher than that inside the sword blade section 12 and the grip section 28 and outside the inner bag 13.

Accordingly, when the soft sword is formed as mentioned above, the sword blade section 12 becomes more stable than that of Example 9.

The method to complete the semi-finished soft sword of this example is as same as that of Example 1, and the explanation shall be omitted.

(EXAMPLE 11)

Figure 14:
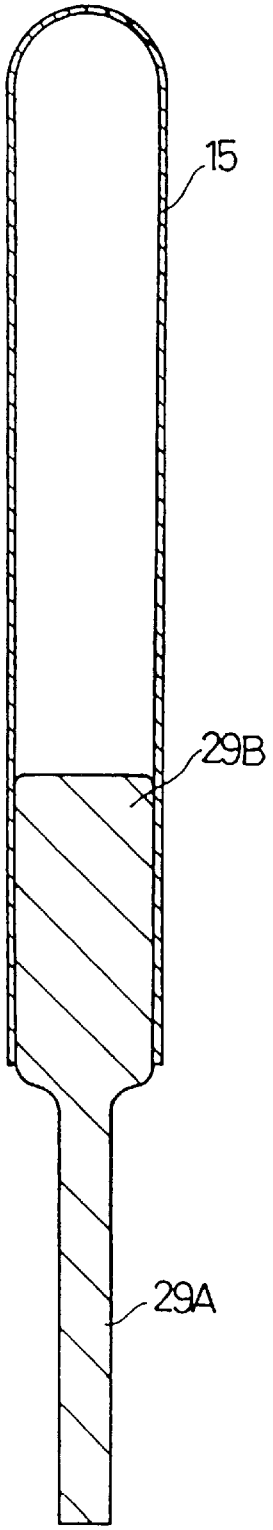
FIG. 14 is a sectional view of a soft sword of Example 11.

FIG. 14 shows a sectional view of a soft sword of Example 11. The soft sword in this figure is semi-finished as those of example 1 to 10.

In this figure, 29A is a grip, which is made of elastic rubber. 29B is a trunk section, which is made in one body with the grip 29A and the diameter of which is larger than that of the grip 29A. 15 is a bag-shaped sword blade section, which is made of rubber. The sword blade section 15 is filled with air to define a cavity and its opening fits onto and closely attaches to the trunk section 29B.

Accordingly, when the soft sword is formed as mentioned above, it can be made more easily than that of Example 1, and the sword blade section 15 is more stable than that of Example 1.

The method to complete the semi-finished soft sword of this example is as same as that of Example 1, and the explanation will be omitted.

(EXAMPLE 12)

Figure 15:
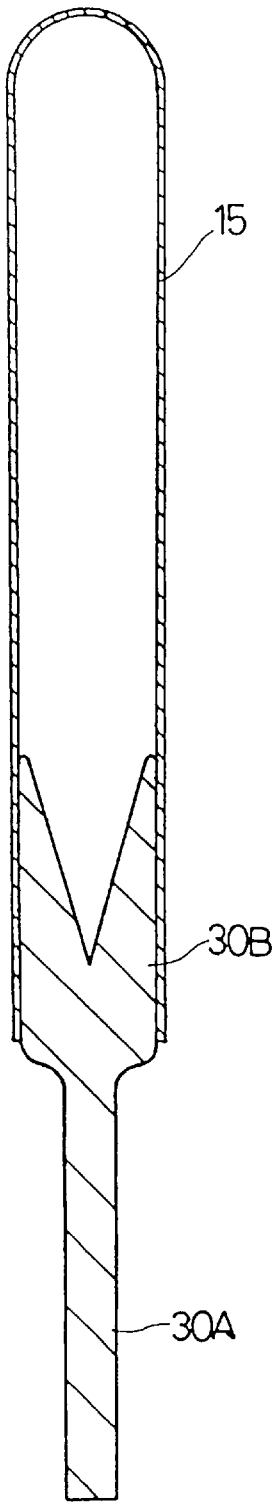
FIG. 15 is a sectional view of a soft sword of Example 12.

FIG. 15 shows a sectional view of a soft sword of Example 12. The soft sword in this figure is semi-finished as those of example 1 to 11.

The soft sword of this example is formed almost as same as that of Example 11, but it is different from that of Example 11 in the point that inside the trunk seciton is bored in the shape of a corn.

Accordingly, when the soft sword is formed as mentioned above, it is more usable than that of Example 11, because the sword blade seciton 15 bends fexibly from its tip end to the trunk section 30B and increases stability when the soft sword swung.

The method to complete the semi-finished soft sword of this example is as same as that of example 1, and the explanation will be omitted.

(EXAMPLE 13)

Figure 16:
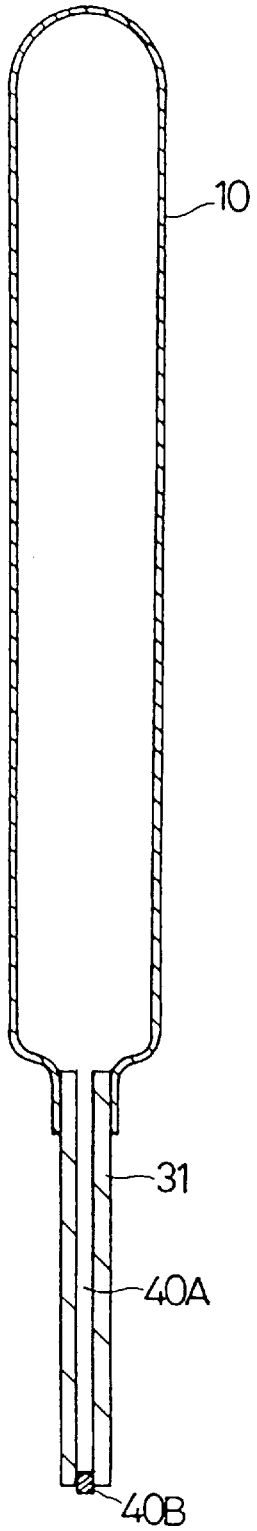
FIG. 16 is a sectional view of a soft sword of Example 13.

FIG. 16 shows a sectional view of a soft sword of Example 13. The soft sword in this figure is semi-finished as those of Examples 1 to 12.

In this figure, 31 is a cylindrical-shaped grip, which is made of wood. 10 is a bag-shaped sword blade section having a throttled opening, which is made of rubber. The opening of the sword blade section 10 fits onto and closely attaches to a tip end of the grip 31. 40A is a vent, which leads to the sword blade section 10 through the grip 31. A valve 40B, through which air is supplied into the sword blade section 10 through the vent 40A and which prevents the air inside the sword blade section 10 from leaking, is at the end of the vent 40A. Though the elasticity of rubber fixes the sword blade section 10 to the grip 31 in this example, the soft sword will be solider if they are glued together. Air is sent from the valve 40B to the sword blade section 10 through the vent 40A, and the sword blade section 10 is filled with air.

Accordingly, when the soft sword is formed as mentioned above, it makes possible to keep the hardness of the sword blade section 10 best, because air can be sent to inside the sword blade section 10 in case that the air inside the sword blade section 10 leaks while the soft sword is used. Besides, the soft sword is made easily, because the sword blade section 10 can be filled with air afterwards.

Figure 17:
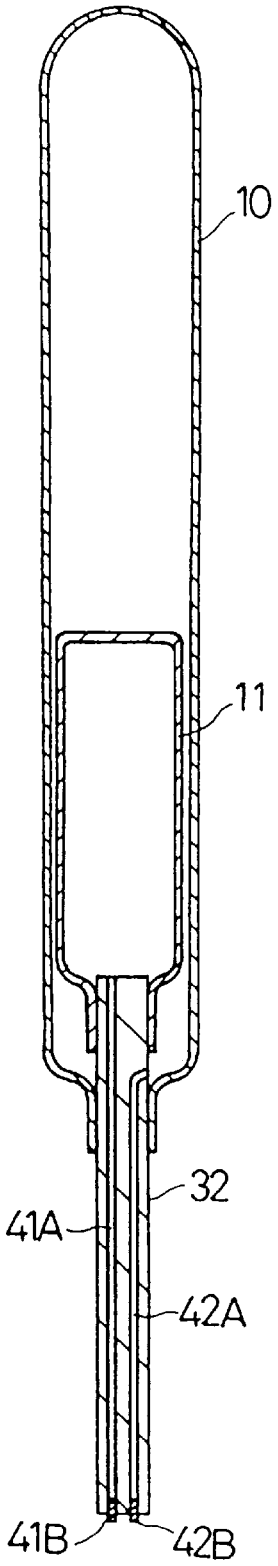
FIG. 17 is a sectional view of a soft sword of Example 13.
Figure 18:
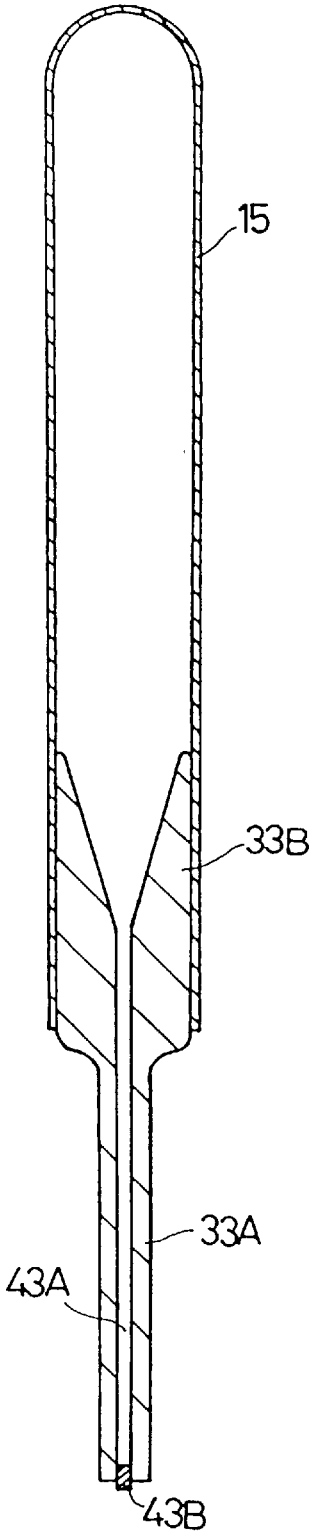
FIG. 18 is a sectional view of a soft sword of Example 13.

Furthermore, it is possible that each of the soft swords of Examples 2 to 8, 11, and 12 has a vent/vents (41A, 42A, 43A) and a valve/valves (41B, 42B, 43B), as shown in FIGS. 17 or 18.

The method to complete the semi-finished soft sword of this example is as same as that of Example 1, and the explanation will be omitted.

(EXAMPLE 14)

Figure 19:
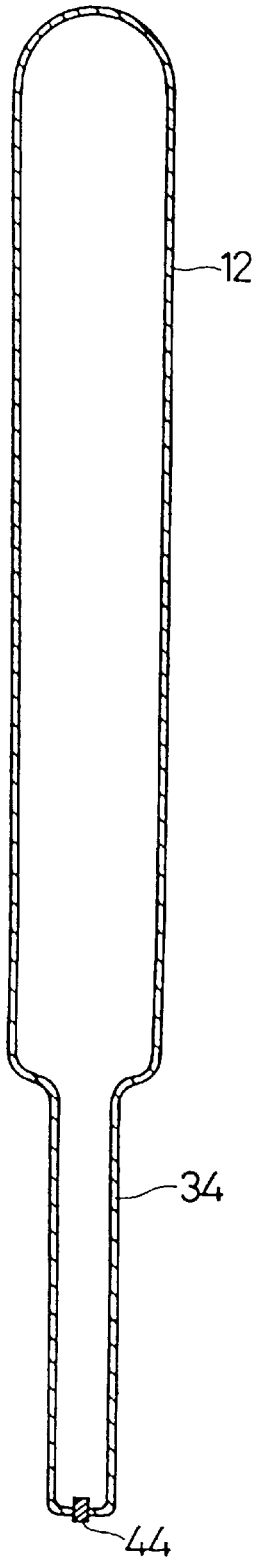
FIG. 19 is a sectional view of a soft sword of Example 14.

FIG. 19 shows a sectional view of a soft sword of Example 14. The soft sword in this figure is semi-finished as those of Examples 1 to 13.

In this figure, 12 is a sword blade section, which is made of rubber. 34 is a grip section, which is thinner than the sword blade section 12, made of the same material as the sword blade section 12, and formed in one body with the sword blade section 12. A valve 44, through which air is supplied into the sword blade section 12 and the grip section 34 and which prevents the air inside the sword blade section 12 and the grip section 34 from leaking, is at the end of the sword blade section 12.

Accordingly, when the soft sword is formed as mentioned above, it makes possible to keep the handiness of the sword blade section 12 best, because air can be sent to inside the sword blade section 12 and the grip section 34 in case that the air inside the sword blade section 12 and the grip section 34 leaks while the soft sword is used. Besides, the soft sword is made easily, because the sword blade section 12 can be filled with air afterwards.

The method to complete the semi-finished soft sword of this example is as same as that of Example 1, and the explanation will be omitted.

(EXAMPLE 15)

Figure 20:
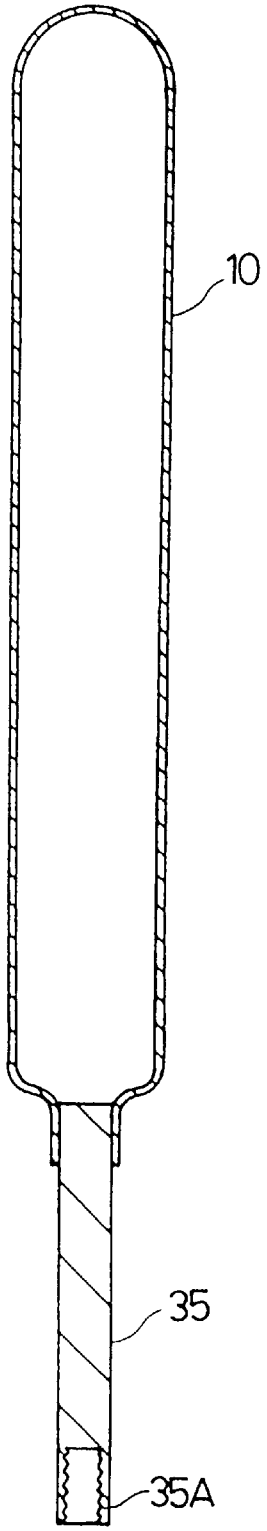
FIG. 20 is a sectional view of a soft sword of Example 15.

FIG. 20 shows a sectional view of a soft sword of Example 15. The soft sword in this figure is semi-finished as those of Examples 1 to 14.

The soft sword of this example is formed almost as same as that of Example 1, but it is different from that of Example 1 in the point that a female screw 35A is formed at the end of the grip 35.

Figure 21A:
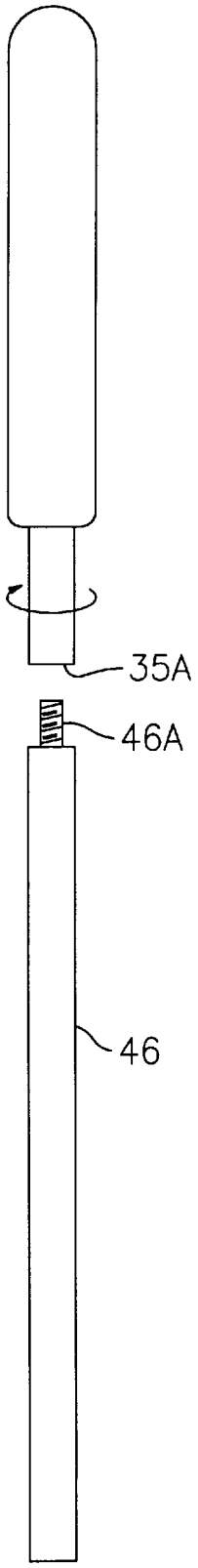
FIG. 21 is an explanatory drawing illustrating how to assemble a soft spear or a soft rod by using a soft sword of Example 15.
Figure 21B:
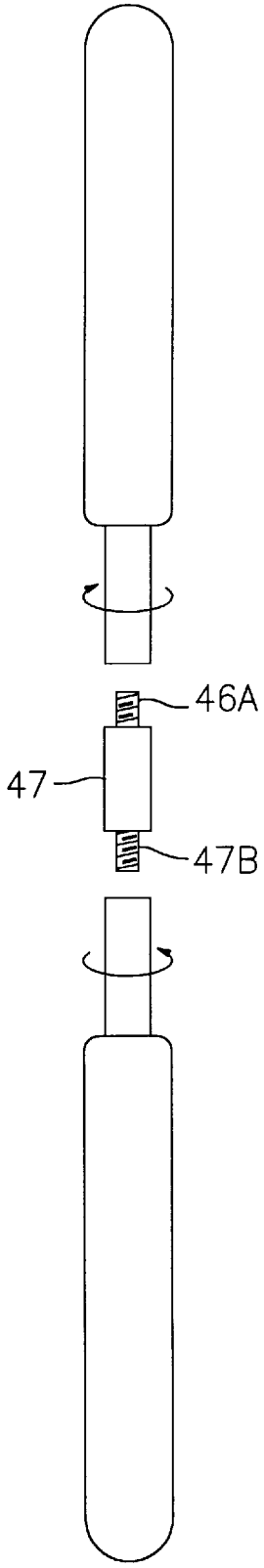

Accordingly, when the soft sword is formed as mentioned above, it can be used as a soft spear, as shown in FIG. 21(A), by setting the male screw 46A at the end of the shaft 46 to the female screw 35A, and it can also be used as a soft rod, as shown in 21(B), by setting the male screws 46A, 46B at both ends of the joint 46 to the female screws 35B.

Not only the soft sword above but also each type of the soft swords of Examples 2 to 8, 11 to 13 may have a female screw at the end of its grip.

Though the drawstring 50A of the cloth bag 50 shown in FIGS. 2 to 4 is divided and does not reach the end of the grip 35 in view of using the soft sword as a soft spear or a soft rod the method to complete the semi-finished soft sword of this example is almost as same as that of Example 1 except for the drawstring 50A, and the explanation will be omitted.

(EXAMPLE 16)

Figure 22:
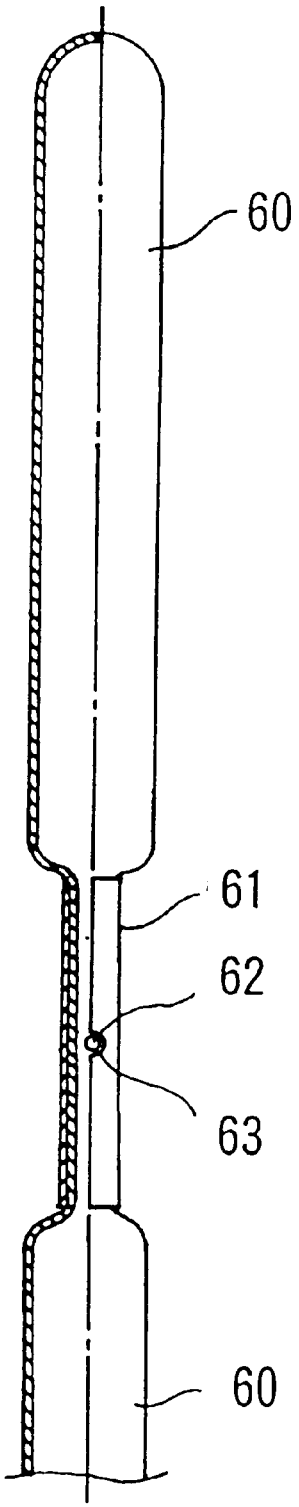
FIG. 22 is a fragmentary sectional view of a soft rod of Example 16.
Figure 23A:
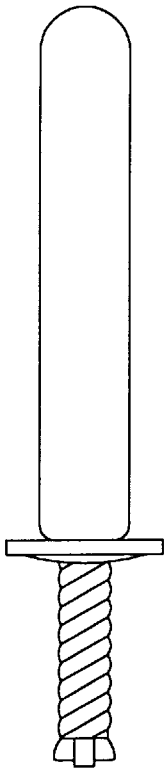
FIG. 23 is a view illustrating sport chanbara goods which have been used.
Figure 23B:
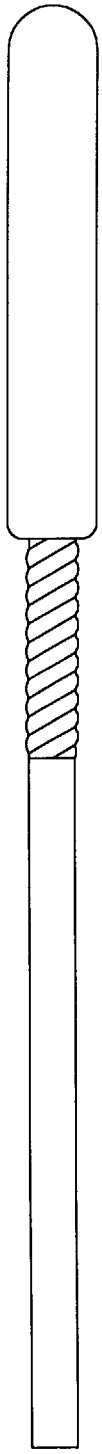
Figure 23C:
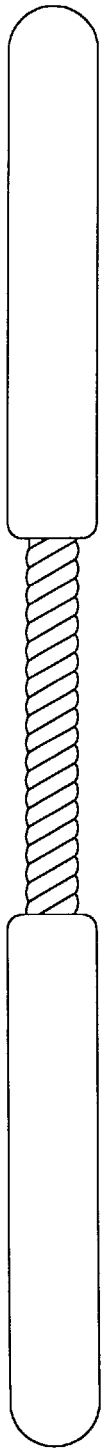
Figure 24:
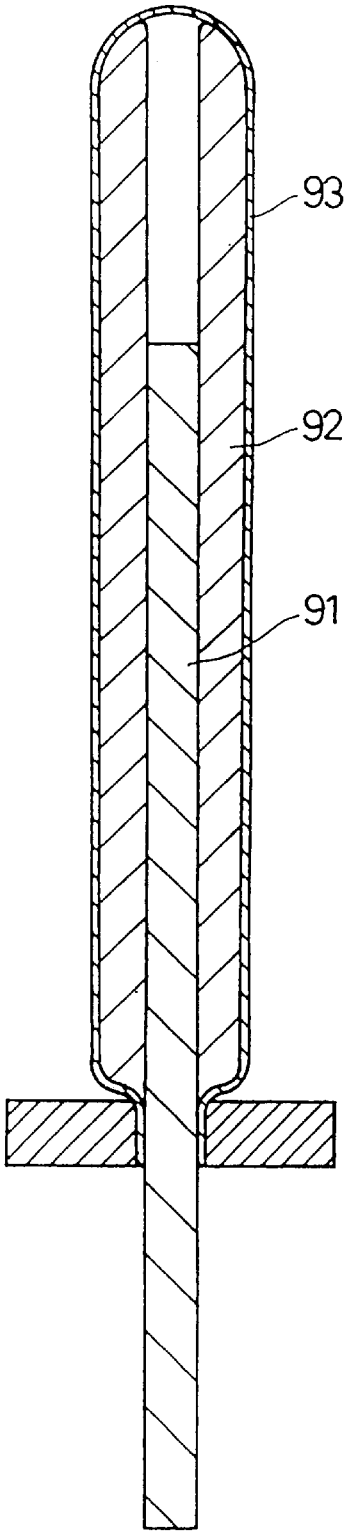
FIG. 24 is a sectional view of a soft sword of prior art.

FIG. 22 shows a fragmentary sectional view of a soft rod of Example 16. The soft rod in this figure is semi-finished as the soft swords of Examples 1 to 14.

In this figure, 60 is a bag-shaped sword blade section, which is made of rubber. A valve 62, through which air is supplied into the sword blade section 60 and which prevents the air inside the sword blade section 60 from leaking, is at the center of the sword blade section 60. The sword blade section 60 does not have opening and is made airtight except the valve 62. 61 is a hollow cylindrical-shaped grip, which has a hole to put the valve 62 into. The sword blade section 60 is inserted to the hollow part of the grip 62, and the valve 62 is put into the hole 63. Then air is sent to the sword blade section 60 through the valve 62, and the sword blade section 60 is filled with air. The air pressure inside the sword blade section 60 fixes the sword blade section 60 to the grip 61 and makes the sword blade section 60 thicker than the grip 60.

Accordingly, when the soft rod is formed as mentioned above, it requires less parts and lower cost, furthermore, is made more easily than that of Example 15.

The method to complete the soft rod will be explained below.

First, the cloth bags 50 shown in FIGS. 2 to 4, a drawstring of which is divided, are put to cover the both side of the sword blade section 60, and the shape of the sword blade section arranged. Then, the griptape is put to wind the grip 61 and the drawstring 50A. In this way, the soft rod is completed.

I claim:

1. A soft sword comprising: a substantially rigid hand grip having an inner stem and an outer portion for holding said soft sword; an elongated sword blade section having a cavity therein and a first closed end and an opposed open end, said blade section made of an elastic material; wherein said inner stem protrudes inside said open end and said outer portion extends from said open end to form a closed cavity in said blade section; and wherein said closed cavity is filled with gas to define an inflatable gas filled closed cavity; and wherein said hand grip permits holding and manipulation of said soft sword, with the gas filled closed cavity working as a cushion when contacting an opponent.

2. A soft sword according to claim 1, wherein said inner stem is thicker than said outer portion.

3. A soft sword according to claim 2, wherein said inner stem and outer portion are at least in part made of the same material and at least in part formed in one body.

4. A soft sword according to claim 1, wherein said inner stem includes an inner section and an outer section wherein the outer section at least in part surrounds the inner portion.

5. A soft sword according to claim 4, wherein said outer section is made of soft material.

6. A soft sword according to claim 5, wherein said outer section is longer than the inner section.

7. A soft sword according to claim 1, wherein said inner stem is at least in part made of softer material than said outer portion.

8. A soft sword according to claim 1, including an outer layer covering said sword blade section.

9. A soft sword according to claim 8, wherein said outer layer is made of a non-elastic material.

10. A soft sword according to claim 8, including a sword guard dividing the sword blade section from the hand grip, and a sword guard stop which prevents the sword guard from dropping.

11. A soft sword according to claim 10, including a stop cock adjacent an end portion of said hand grip.

12. A soft sword according to claim 11, including friction means covering said hand grip to minimize slippage through a user's hand.

13. A soft sword according to claim 1, wherein said inner stem is thinner than said outer portion.

14. A soft sword according to claim 1, wherein said inner stem reaches the closed end of said sword blade section.

15. A soft sword according to claim 1, wherein the grip includes an inner, elongated section made of elastic material and having a cavity therein inside said blade section and having a first closed end and an opposed open end wherein the open end of said inner section is fitted onto and closely attached to said grip to form an inner section closed cavity therein, and wherein said inner section closed cavity is filled with gas to form a gas filled closed inner cavity which is separate from the closed cavity of the sword blade section.

16. A soft sword according to claim 15, wherein pressure inside the inner section closed cavity is higher than pressure inside the closed cavity of the sword blade section.

17. A soft sword according to claim 1, wherein said grip includes a trunk section which is formed in one body with said grip and which is thicker than said grip, and wherein said sword blade section open end is fitted onto and closely attached to said trunk section.

18. A soft sword according to claim 17, wherein said trunk section has a forward end spaced from said grip which has a bored opening therein.

19. A soft sword according to claim 1, wherein said grip has an end portion spaced from said blade section, and including a vent extending from the end portion of said grip to the closed cavity and through which gas can be supplied into said closed cavity, and a valve associated with said vent which prevents gas inside said closed cavity from leaking out said vent and through which gas can be supplied into said closed cavity.

20. A soft sword according to claim 15, wherein said grip has an end portion spaced from said blade section, including a first vent extending from the end portion of said grip to the closed cavity of the sword blade section and through which gas can be supplied into said closed cavity of the sword blade section, a first valve associated with said first vent which prevents gas inside said closed cavity of the sword blade section from leaking out said vent and through which gas can be supplied into said closed cavity of the sword blade section, a second vent extending from the end portion of said grip to the inner section closed cavity and through which gas can be supplied into said inner section closed cavity, and a second valve associated with said second vent which prevents gas inside said inner section closed cavity from leaking out said vent and through which gas can be supplied into said inner section closed cavity.

21. A soft sword according to claim 1, wherein said grip has an end portion spaced from said blade section, and including a screw section at the end portion of said grip.

* * * * *